US006032094A

United States Patent [19]

Yanagi et al.

[11] Patent Number: 6,032,094

[45] Date of Patent: Feb. 29, 2000

[54] ANTI-TOPPLING DEVICE FOR CONSTRUCTION MACHINE

[75] Inventors: Kunikazu Yanagi, Hiratsuka; Hiroshi Yoshinada, Machida; Naritoshi Ohtsukasa, Isehara; Kenji Okamura, Hiratsuka, all of Japan

[73] Assignee: Komatsu Ltd., Japan

[21] Appl. No.: 09/014,869

[22] Filed: Jan. 28, 1998

[30] Foreign Application Priority Data

Jan. 31, 1997 [JP] Japan ..... 9-018835
Sep. 26, 1997 [JP] Japan ..... 9-261938

[51] Int. Cl.[7] ..... E02F 3/00; G06F 17/00

[52] U.S. Cl. ..... 701/50; 37/418; 340/440

[58] Field of Search ..... 701/50; 37/413, 37/418; 340/440

[56] References Cited

U.S. PATENT DOCUMENTS 3,909,962 10/1975 Guinot ..... 37/410
4,098,538 7/1978 Hilton ..... 299/33
4,444,542 4/1984 Shaw et al. ..... 414/694
5,704,141 1/1998 Miura et al. ..... 37/348

*Primary Examiner*—Michael J. Zanelli
*Attorney, Agent, or Firm*—Greer, Burns & Crain, Ltd.

[57] ABSTRACT

To prevent toppling of a construction machine where a plurality of operating tools are provided on a single mobile platform, a control section detects the cylinder axial forces, joint angles and relative angle of rotation for a plurality of operating tools provided rotatably on a single mobile platform, and a moment calculator calculates a composite moment for the plurality of operating tools on the basis of these detection results and further calculates a stability value relating to toppling, from this composite moment and a reference moment. If the calculated stability value is less than a reference value, an anti-toppling controller issues an alarm from the alarm via an output controller and halts the operation of the plurality of operating tools, or alternatively, if the operation of the operating lever input via the lever gain calculator will cause the stability to fall below a set value, it controls a hydraulic control section such that the action of the operating tool corresponding to this operation is prohibited. By allowing the operating tool located on the base where the control section and hydraulic control section are installed to be detected by electrical signals, but using pressure signals only for the other operating tools, the need for electrical swivels between the plurality of devices is removed.

18 Claims, 11 Drawing Sheets

ANTI-TOPPLING DEVICE FOR CONSTRUCTION MACHINE

BACKGROUND OF THE INVENTION

1. Field of the Invention

The present invention relates to an anti-toppling device for a construction machine capable of preventing completely the toppling of a construction machine which moves by means of a mobile platform and performs operations by means of a plurality of operating tools.

2. Description of the Related Art

Conventionally, anti-toppling devices for construction machinery have been most advanced in the field of cranes, and anti-toppling algorithms used therein have essentially been implemented as follows.

(1) the total load moment about the boom fulcrum is calculated from the axial force in the hydraulic cylinder of the boom and the angle of the boom;

(2) the moment about the boom fulcrum due to the operating tools alone is calculated from the angles of all the operating tools and the weight and centre of gravity of all the operating tools;

(3) the magnitude of suspended loads is found from (1) and (2) above by dividing by the distance to the position of each suspended load;

(4) the toppling moment generated by the operating tools about the toppling fulcrum is found from the weight, centre of gravity, suspended load and position of suspended load for each operating tool; and (5) a value derived by multiplying a safety coefficient to the stability moment generated about the toppling fulcrum by the weight of the vehicle excluding the operating tools is recorded. Judging means for judging if the toppling moment in (4) above exceeds this value are provided, and an anti-toppling measures are taken by issuing an alarm, and halting the operating tools, etc., on the basis of the results from the judging means.

Furthermore, an anti-toppling device of this kind has also been applied to a construction machine such as a hydraulic shovel, or the like (Japanese Patent Publication 2-45737, Japanese Laid-open Patent Application 5-202535).

Incidentally, in construction machines such as the crane or hydraulic shovel described above, only a single operating tool is mounted on the mobile platform, and therefore the anti-toppling device performs anti-toppling calculations with respect to one operating tool only.

However, in construction machines having a plurality of operating tools on a single mobile platform, each operating tool is capable of turning independently, and in some cases, operating tools are used conjointly in the same direction, so when an operating tool is holding a load in this direction, there is the risk that the construction machine will topple over, whereas if the operating tools are positioned in opposing directions, the device will not be liable to topple over, even if it is holding a load or loads.

In a construction machine comprising a plurality of operating tools on a single mobile platform, the positional relationships between the different operating tools vary widely, including their direction of rotation, and the moments of the operating tools vary widely depending on their direction of rotation. Therefore, even if these moments are calculated simply on the axial drive force of the boom and the angle of operation, it is not simple to determine the possibility for the construction machine as a whole to topple over.

Furthermore, it is also difficult for a person operating a construction machine generating complex moments of this kind to determine instantly how he or she should operate the operating tools in order to avoid toppling, and a suitable device for avoiding toppling is difficult to design.

SUMMARY OF THE INVENTION

Therefore, it is an object of the present invention to eliminate these problems and to provide an anti-toppling device for a construction machine whereby toppling can be prevented reliably and simply in every situations, and the burden on the operator for preventing the machine from toppling over is reduced, even in the situation where a plurality of operating tools are mounted on a single mobile platform.

In order to achieve this object, in a first aspect of the invention, an anti-toppling device for a construction machine which moves by means of a mobile platform and performs tasks by means of a plurality of operating tools, comprises: first detecting means for detecting the relative angle of rotation of the plurality of operating tools; a plurality of second detecting means for detecting the values of the moment components contributing to toppling for each of the plurality operating tools; and control means for judging the toppling of the construction machine on the basis of the detection signals from the first and second detecting means and controlling the construction machine such that it is prevented from toppling over on the basis of these judgement results.

As a result, in the first aspect of the invention, it is possible to prevent toppling of a construction machine simply and reliably by taking consideration of the relative positional relationships of the plurality of operating tools based on their relative angle of rotation, and by preventing toppling in this manner, operating efficiency of the plurality of operating tools is dramatically improved.

A second aspect of the invention is characterized in that, in the first aspect of the invention, when the value of the moment component in a particular operating tool as indicated by the detection signal from the second detecting means corresponding to the operating tool exceeds a specific value previously determined on the basis of the moment of the particular operating tool in an operational state where the operational state of the particular operating tool contributes towards the toppling of the construction machine, the control means determines that the current operational state of the particular operating tool is contributing towards the toppling of the construction machine.

Thereby, a construction machine can be prevented efficiently from toppling over, and the amount of control required to prevent toppling is reduced. In particular, the number of detection means required for controlling toppling can be reduced.

A third aspect of the invention is characterized in that, in the second aspect of the invention, the second detection means corresponding to the particular operating tool detects the value of the moment component of the particular operating tool by means of pressure.

Thereby, only hydraulic swivels are required between the plurality of operating tools, and no electrical swivels need to be provided specially for preventing toppling, so the composition of the construction machine itself is simplified and no significant design modifications are required for preventing toppling.

A fourth aspect of the invention is characterized in that, in the second or third aspect of the invention, the second detecting means corresponding to the particular operating tool is provided on the base of the operating tool where the control means is located.

Thereby, the anti-toppling device detects the moment components of a plurality of operating tools on the base of a single operating tool where the control means is located, and it is able to control and prevent toppling accordingly, so the composition of the construction machine itself is simplified, similarly to the third aspect of the invention, and no significant design modifications are required for preventing toppling. This effect is particularly important when the number of operating tools increases.

A fifth aspect of the invention is characterized in that, in the first aspect of the invention, when the control means judges toppling of the construction machine by comparing the value of the moment component due to a particular operating tool as indicated by the detection signal from the second detection means corresponding to the particular operating tool with a specific value previously determined on the basis of the moment of the particular operating tool in an operational state where the operational state of the particular operating tool contributes towards the toppling of the construction machine, the specific value is corrected to a value corresponding to the relative angle of rotation as detected by the first detecting means.

Thereby, it is possible to control and prevent toppling in a flexible and appropriate manner which is responsive to the positional relationships of the operating tools, based on their state, and especially, their relative angle of rotation.

A sixth aspect of the invention is characterized in that, in the first aspect of the invention, when the control means judges toppling of the construction machine by comparing the value of the moment component due to a particular operating tool as indicated by the detection signal from the second detection means corresponding to the particular operating tool with a specific value previously determined on the basis of the moment of the particular operating tool in an operational state whereby the operational state of the particular operating tool contributes towards the toppling of the construction machine, the value of the moment component is corrected to a value corresponding to the relative angle of rotation as detected by the first detection means.

Thereby, it is possible to judge toppling in a flexible and appropriate manner which accounts for the relative angle of rotation.

A seventh aspect of the invention is characterized in that, in the fifth or sixth aspect of the invention, the control means corrects the values to values allowing a greater margin for toppling of the construction machine as the relative angle of rotation increases.

Thereby, it is possible to judge toppling in a flexible and appropriate manner which accounts for the relative angle of rotation.

An eighth aspect of the invention is characterized in that, in the first or second aspect of the invention, the control means calculates the moment due to an operating tool which is contributing significantly to the toppling of the construction machine on the basis of the value of a plurality of moment components indicated by the detection signals from the second detection means corresponding to that operating tool, and if the value of these moments exceeds a predetermined value, then it judges that the current operational state of this operating tool will contribute to the toppling of the construction machine.

Thereby, it is possible to judge toppling to a relatively high degree of accuracy, in a simple and reliable manner. Furthermore, since the contribution of the operating tools themselves to the toppling of the machine are judged by moment components alone, depending on the operating tool, the processing load involved in controlling toppling is reduced.

A ninth aspect of the invention is characterized in that, in the first aspect of the invention, the control means judges that there is a possibility of the construction machine toppling over when the value of the moment component indicated by the detection signal from the second detection means corresponding to one of the operating tools exceeds a specific value, and the value of the moment component indicated by the detection signal from the second detection means corresponding to the other of the operating tools exceeds a reference value corrected in response to the relative angle of rotation.

Thereby, it is possible to implement reliable and simple judgement of toppling in a practical manner.

A tenth aspect of the invention is characterized in that, in the first aspect of the invention, moment calculating means are also provided for calculating a composite moment for the whole of the construction machine on the basis of the detection signals from the first and second detection means, and the control means compares the calculation result of the moment calculating means with a prescribed reference moment indicating the possibility of the construction machine toppling over, and judges that there is the possibility of the construction machine toppling over when the composite moment exceeds the prescribed reference moment.

Thereby, since the moment of the construction machine as a whole is taken into consideration, it is possible to judge toppling with a high degree of accuracy.

An eleventh aspect of the invention is characterized in that, in the first to tenth aspects of the invention, at least one of the plurality of operating tools can be rotated.

Thereby, it is possible to prevent toppling reliably and simply, even if the plurality of operating tools comprises rotatable operating tools. Furthermore, if at least one of the operating tools can be rotated, then although the procedure for avoiding toppling is complex and it is difficult for the operator to respond instantly, because the positions of the operating tools is complicated, it is still possible completely to prevent toppling of the construction machine in a reliable and simple manner.

A twelfth aspect of the invention is characterized in that, in the first to eleventh aspects of the invention, the control means implements control such that the relative angle of rotation is increased when the judging means judges that there is a possibility of the toppling.

Thereby, even if, for example, there is an obstacle between one of the operating tools and the ground and the operating tool cannot be operated in a vertical direction, it is still possible to prevent toppling reliably.

A thirteenth aspect of the invention is characterized in that, in the first to twelfth aspects of the invention, the control means implements control such that at least one of the plurality of operating tools is halted, when the judging means judges that there is a possibility of toppling.

Thereby, toppling of the machine can be prevented reliably.

A fourteenth aspect of the invention is characterized in that, in the first to thirteenth aspects of the invention, the control means implements control such that it prohibits operation of the operating tools which increase the possibility of toppling, when the judging means judges that there is a possibility of toppling.

Thereby, it is possible completely to prevent operations based on mistaken judgements by the operator.

A fifteenth aspect of the invention is characterized in that, in the first to fourteenth aspects of the invention, the control means implements control such that the operating tool is relocated to a position which reduces the possibility of toppling, when the judging means judges that there is the possibility of toppling.

Thereby, it is possible to reduce the burden on the operator in relation to preventing toppling.

A sixteenth aspect of the invention is characterized in that, in the first to fifteenth aspects of the invention, the control means implements control such that when the possibility of toppling has increased whilst one of the operating tools is at rest due to a change in the position of another operating tool, the operating tool which is at rest is relocated to a position which reduces the possibility of toppling.

Thereby, it is possible to use an operating tool which is at rest for a long time effectively to prevent toppling.

A seventeenth aspect of the invention is characterized in that, in the first to sixteenth aspects of the invention, the control means implements control such that the plurality of operating tools are halted and thereafter, operation of those operating tools of the plurality of operating tools which do not contribute to toppling is permitted, when the judging means judges that there is a possibility of toppling.

Thereby, it is possible to reduce the burden on the operator relating to preventing toppling.

An eighteenth aspect of the invention is characterized in that, in the first to seventeenth aspects of the invention, warning means for warning of the danger of the construction machine toppling over are also provided, and the control means implements control such that a warning is issued by the warning means at least, when it is judged that there is a possibility of toppling.

Thereby, it is possible reliably to transmit the possibility of toppling to the operator.

DESCRIPTION OF THE PREFERRED EMBODIMENTS

Embodiments of the present invention are described below with reference to the drawings.

Figure 1:
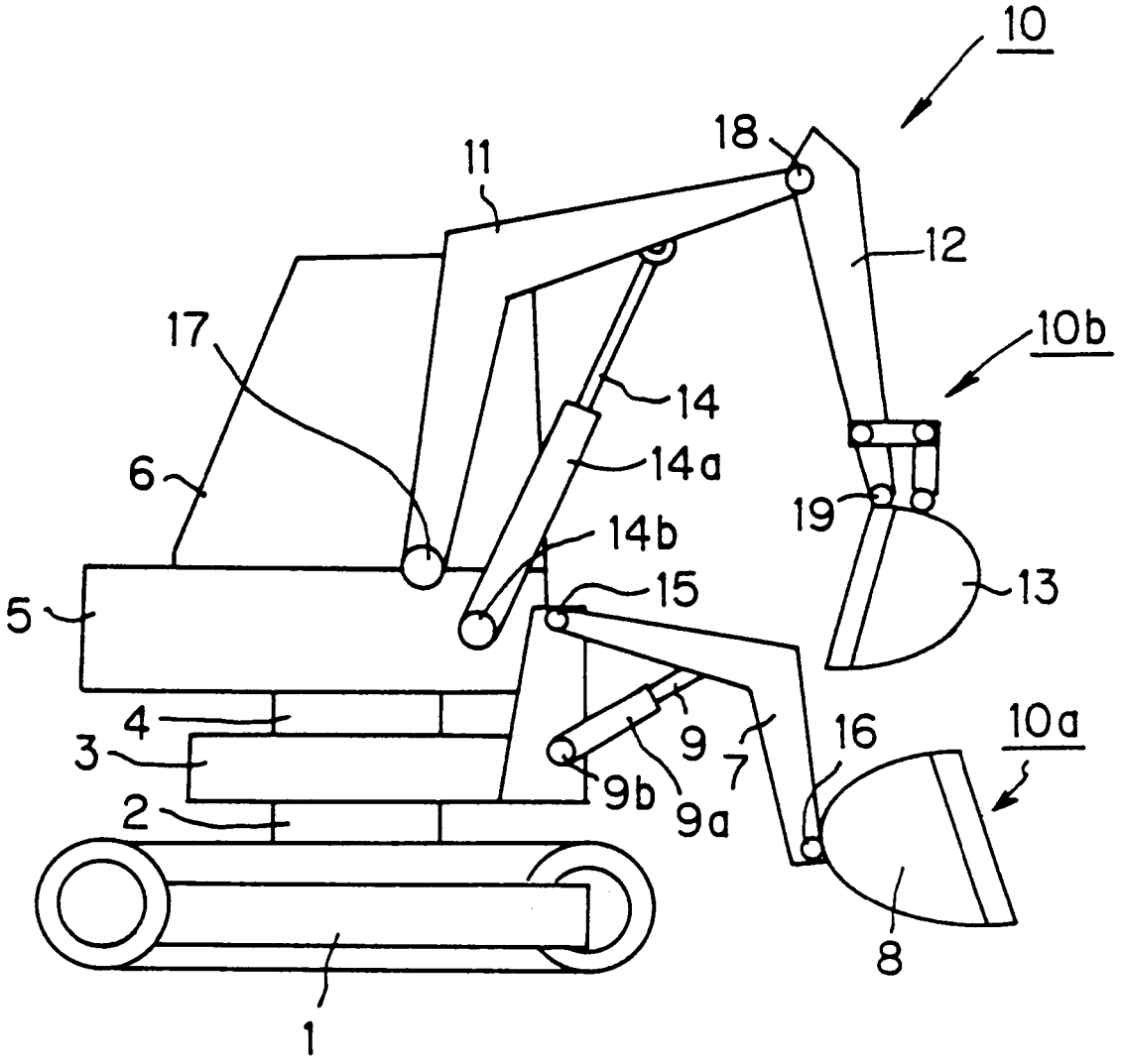
FIG. 1 is a side view showing a configuration of a construction machine which is a first embodiment for implementing the present invention.

FIG. 1 is a side view showing the configuration of a construction machine 10 which is a first embodiment for implementing the present invention. In FIG. 1, the mobile platform 1 is a crawler type, but it may also be a wheeled vehicle.

A rotating mechanism 2 capable of rotating through 360° in a horizontal direction is installed on top of a mobile platform 1, and a base 3 is fixed to this rotating mechanism 2. A loading tool 10*a* is supported at the end of the base 3. The loading tool 10*a* is supported at the end portion of the base 3 and it comprises a loader arm 7 driven by a lift cylinder 9 and a loader bucket 8 supported on the end of the loader arm 7.

Moreover, a rotating mechanism 4 capable of rotating through 360° in the horizontal direction is provided on top of the base 3, and a base 5 is fixed to this rotating mechanism 4. A back-hoe tool 10*b* is supported on the end portion of this base 5. The back-hoe tool 10*b* is supported on the end portion of the base 5 and it comprises a boom 11 driven by a boom cylinder 14, an arm 12 supported on the end of this boom 11, and a bucket 13 supported on the end of this arm 12. A driver's cabin 6 is fixed on top of the base 5, and the operator manipulates the loading tool 10*a* and the back-hoe tool 10*b* from this driver s cabin 6.

The mobile platform 1 comprises a rotating motor for causing the rotating mechanism 2 to rotate, and the base 5 comprises a rotating motor for causing the rotating mechanism 4 to rotate. Furthermore, angle detectors 15, 16, constituted by rotary encoders, rotational potentiometers, or the like, for detecting angles of rotation are provided in the rotating axes at each joint section in the loading tool 10*a*. Similarly, angle detectors 17, 18, 19 for detecting angles of rotation are provided in the rotating axes at each joint section of the back-hoe tool 10*b*. A pressure detector 9*b* for detecting bottom pressure and a pressure detector 9*a* for detecting head pressure are provided in the lift cylinder 9. A pressure detector 14*b* for detecting bottom pressure and a pressure detector 14*a* for detecting head pressure are also provided in the boom cylinder 14. The pressure detectors may be constituted by a pressure sensors, load cells, or the like.

In this way, the construction machine 10 comprises two operating tools, a loading tool 10*a* and a back-hoe tool 10*b*, provided on a single mobile platform 1, and both of the operating tools 10*a*, 10*b* are capable of rotating independently through 360°. The driver's cabin 6 is fixed to the base 5, but of course a further rotating mechanism may also be fixed onto the base 5, such that the driver's cabin 6 can be rotated independently thereby.

Figure 2:
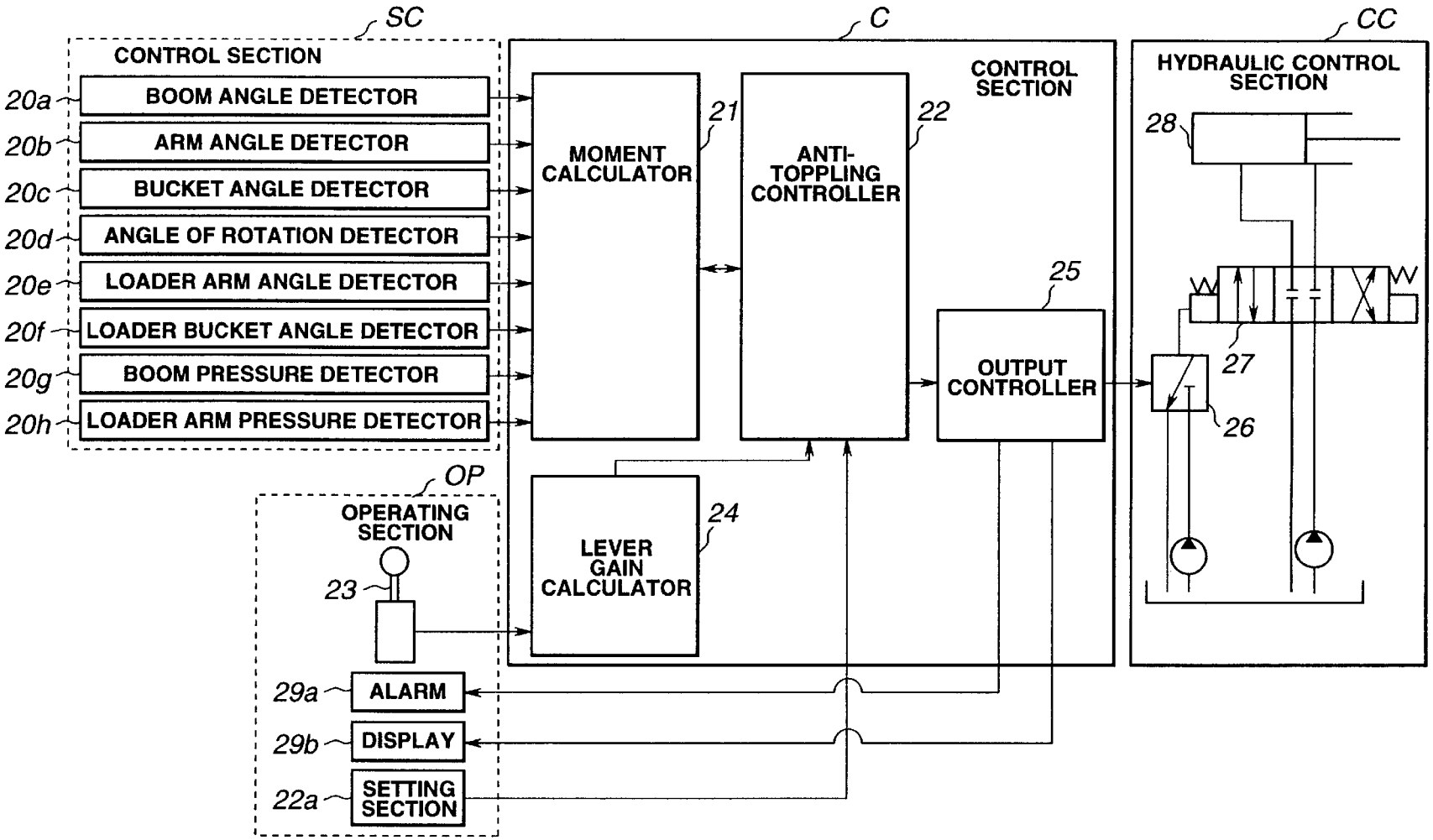
FIG. 2 shows the composition of an anti-toppling device for a construction machine of the first embodiment.

Next, an anti-toppling device for the construction machine 10 shown in FIG. 1 is described with reference to FIG. 2. Furthermore, below, "stability" is used as a measure of the propensity of the machine to topple. When this stability is high, there is no danger of toppling and when it is low, there is a high probability of toppling. FIG. 2 shows the configuration of an anti-toppling device for the construction machine 10, and in broad terms, this anti-toppling device consists of a detecting section SC, operating section OP, control section C and hydraulic control CC.

The detecting section SC comprises a plurality of detectors 20*a*–20*h*, and each of these detectors 20*a*–20*h* gathers information from a corresponding rotational motor, angle detector or pressure detector, and converts the detection results to information of a prescribed format, which it then transmits to the control section C. In other words, the boom angle detector 20*a*, arm angle detector 20*b*, bucket angle detector 20*c*, long arm angle detector 20*e*, and loader bucket angle detector 20*f* reconvert angle information detected respectively by angle detectors 17, 18, 19, 15, 16 to analogue or digital electrical signals, and transmit these to the control section C. Furthermore, the angle of rotation detector 20*d* takes the angle of rotation due to the rotational motor driving rotating mechanism 2 and the angle of rotation due to the rotational motor driving rotating mechanism 4 and converts these to an electrical signal corresponding to the relative angle of rotation, which is transmitted to the control section C. The boom pressure detector 20*g* subtracts the product of the head pressure as detected by pressure detector 14*a* and the head surface area from the product of the bottom pressure as detected by pressure detector 14*b* and the bottom surface area, in other words, it calculates the boom cylinder axial force and transmits an electrical signal corresponding to this boom cylinder axial force to the control section C. Similarly, the loader arm pressure detector 20*h* takes the detection results from pressure detectors 9*a*, 9*b* and converts them to an electrical signal corresponding to the axial force in the lift cylinder 9, which it transmits to the control section C. The various conversion functions in the detection section SC may be accommodated in the moment calculator 21, which is described later.

The control section C comprises a moment calculator 21, an anti-toppling controller 22, a lever gain calculator 24, and an output controller 25.

The moment calculator 21 derives a composite moment for the construction machine in its current position on the basis of the angles of the joint sections in the operating tools 10*a*, 10*b*, as input from the detecting section SC, the boom cylinder axial force and the lift cylinder axial force, and the relative rotational angles, and it calculates the stability of the machine by comparing this composite moment with a prescribed reference moment, and transmits at least this calculation result to the anti-toppling controller 22. The calculational processing involved in this moment calculator 21 is described later.

The anti-toppling controller 22 judges whether or not the stability value input from the moment calculator 21 is below a prescribed level, and it conducts a variety of anti-toppling control processing on the basis of these judgement results.

On the basis of the control processing results from the anti-toppling control processing section 22, the output controller 25 implements control which is output to the hydraulic control section CC which controls the hydraulic sections of the operating tools 10*a*, 10*b*, an alarm section 29*a* which gives a notification when there is a possibility of toppling, display 29*b* which displays the danger of toppling of the stability value described above, at the least, in a sequential manner, and the like.

The hydraulic control section CC controls the hydraulic cylinder 28 of the lift cylinder 9 or boom cylinder 14, or the like. The output control electrical signal from the output controller 25 is input to an electromagnetic proportional valve 26 which outputs a pilot pressure for controlling a main valve 27 to the main valve 27 on the basis of this output control electrical signal. The main valve 27 controls switching on the basis of the input pilot pressure, thereby controlling the driving of the hydraulic cylinder 28. Incidentally, FIG. 2 relates to control of the hydraulic cylinder 28, but when controlling the rotating mechanisms 2, 4, the hydraulic motors forming the rotational motors are subjected to this control processing.

Next, the calculational procedure implemented in the moment calculator 21 is described with reference to FIG. 3 and FIGS. 4(*a*) and 4(*b*). Firstly, the moment calculator 21 calculates the loads on the loader bucket 8 and the bucket 13 from the detection results input by detecting section SC by means of the angles of rotation and the axial forces in the cylinders. For example, when calculating the load on the loader bucket 8, firstly, the distances to the centre of gravity of the loader arm 7 and the loader bucket 8 are calculated from the loader arm angle output by the loader arm angle detector 20*b* and the loader bucket angle output by the loader bucket angle detector 20*f*, and since the weight of the loader arm 7 and loader bucket 8 are already known, the axial force in the lift cylinder is determined from the loader pressure detector 20*h* and hence the load on the loader bucket 8 alone is calculated. The load on the bucket 13 is calculated in a similar manner.

Thereupon, the toppling moment about the centre of rotation CN of the construction machine 10 main unit, in other words, a composite moment of the main sections constituting the construction machine 10, is derived, and the composite distance of this composite moment is determined by means of the following equation.

$$L=(M1\times L1-M2\times L2-M5\times L5-M3\times L3\cos\theta-M6\times L6\cos\theta-M4\times L4)/M$$

where

M: weight of whole construction machine

M1: weight of structure including bases 3, 5 which rotate on mobile platform 1 by means of rotating mechanisms 2, 4 (excluding loading tool 10*a* and back-hoe tool 10*b*)

M2: weight of back-hoe tool 10*b*

M3: weight of loading tool 10*a*

M4: weight of mobile platform 1

M5: load weight on back-hoe tool 10*b*

M6: load weight on loading tool 10*a*

L1: distance of centre of gravity from centre of rotation of upper structure including base 5 which rotates by means of rotating mechanism 4 (excluding back-hoe tool 10*b*)

L2: distance of centre of gravity from centre of rotation of back-hoe tool 10*b*

L3: distance of centre of gravity from centre of rotation of loading tool 10*a*

L4: distance of centre of gravity from centre of rotation of mobile platform 1

L5: distance to centre of gravity of load on back-hoe tool 10*b*

L6: distance to centre of gravity of load on loading tool 10*a*

θ: relative angle of rotation of loading tool 10*a* with respect to back-hoe tool 10*b*

Figure 3:
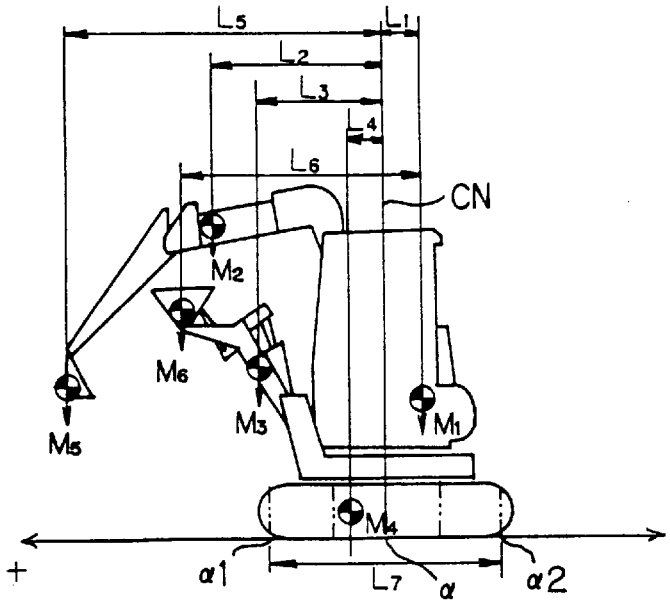
FIG. 3 is a diagram illustrating the essential points for calculating composite moments.
Figure 4A:
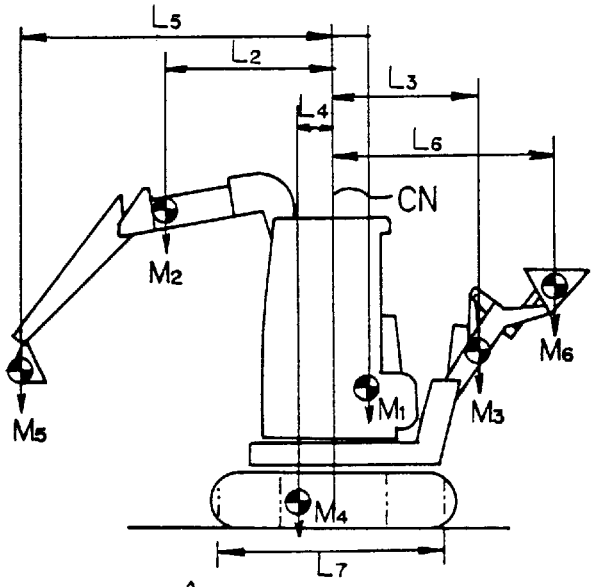
FIGS. 4(*a*) and 4(*b*) are diagrams illustrating the essential points for calculating composite moments.
Figure 4B:
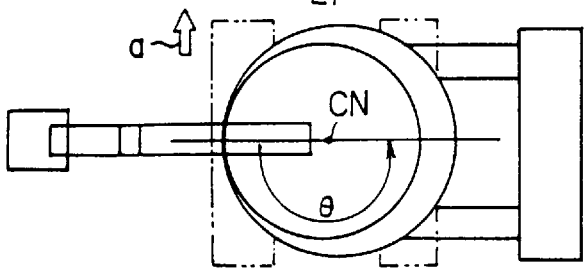

(See FIG. 3 and FIGS. 4(*a*) and 4(*b*).) Here, a point on the line of the centre of rotation CN, for example, the point where the line of the centre of rotation CN intersects with the ground, is set as a hypothetical toppling fulcrum α. Therefore, the composite distance L is a hypothetical distance. L is taken as a hypothetical distance in this way, because there are two actual toppling fulcrums α1, α2, where the ends of the mobile platform contact the ground. Furthermore, in the distances to the centre of gravity of each part constituting the construction machine 10, the vertical distance component has been omitted. Naturally, the distances from the hypothetical toppling fulcrum to the centres of gravity may also be calculated precisely.

When the loading tool 10*b* and the back-hoe tool 10*a* are positioned in different directions, as illustrated in FIG. 4(*a*), the relative angle of rotation θ in the horizontal plane is taken into consideration. Namely, the moment on the side of the loading tool 10*b* is multiplied by cos θ; when θ is 180°, cos θ=−1, which means that the inverse moment is applied. From the composite length L derived as described above, the moment calculator 21 calculates the stability S (as a percentage value) using the following equation.

$$S=(L7/2-L)/L7\times 100$$

where L7: length of mobile platform 1 in sideways direction.

L7 is the shortest length of the mobile platform 1 in contact with the ground in the horizontal plane. In other words, it is the shortest length in contact with the ground in the direction perpendicular to the direction of travel (sideways direction) as shown in FIG. 4(*b*). Here, "L7/2−L" is calculated as the distance from the actual toppling fulcrum α1. In other words, the actual centre of gravity of the construction machine 10 when it is bearing a load or the like, is located at a distance L from the hypothetical toppling fulcrum in the direction of the actual toppling fulcrum α1, and the position of the centre of gravity when the machine is stationary and stable in its initial state is located at the hypothetical toppling fulcrum α, and therefore the distances are converted to distances from the actual toppling fulcrum α1. Here, the distance L7/2 from the actual toppling fulcrum α1 to the centre of gravity (hypothetical toppling fulcrum) α is taken as the distance of the reference moment. When the distance "L7/2−L" is negative, this indicates that the composite distance L is greater than the distance L7/2, which corresponds to a case where the centre of gravity to the left of the actual toppling fulcrum α1 in FIG. 3. Therefore, if the value of "L7/2−L" is greater than 0 and less than L7/2, the device will not topple over, but when this value is small, this means that the machine has approached the actual toppling fulcrum α1 and is in danger of toppling over.

Therefore, when the stability S calculated by the moment calculator 21 is output to the anti-toppling controller 22, the anti-toppling controller 22, having set a predetermined specific stability value Ss of 15%, for example, determines that there is a danger of toppling if the input stability value S is equal to or less than 15%. Furthermore, if toppling at the actual toppling fulcrum α2 is considered, in other words, if the composite distance L is negative, then the stability S should be calculated by "L7/2+L" rather than "L7/2−L". Of course, the stability S with reference to the loading tool 10*b* may also be calculated separately.

Next, an anti-toppling control processing sequence as implemented by the anti-toppling controller 22 is described with reference to the flow-chart shown in FIG. 5.

Figure 5:
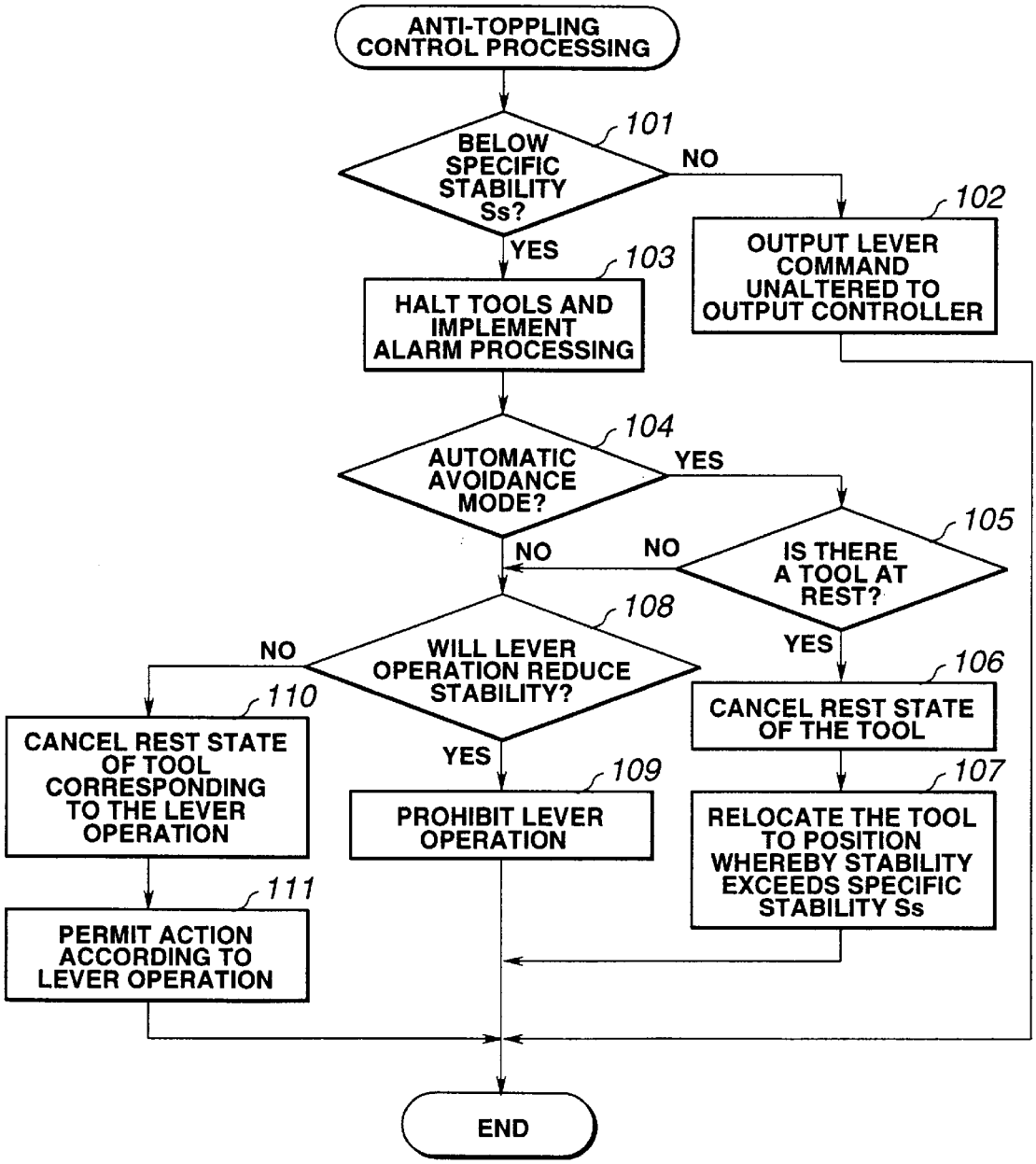
FIG. 5 is a flowchart showing a control sequence for preventing toppling implemented in an anti-toppling controller 22.

In FIG. 5, firstly, the anti-toppling controller 22 judges whether or not the stability S input from the moment calculator 21 is equal to or less than the previously determined specific stability value Ss (step 101). If it is not equal to or less than the specific stability value Ss, then a command from the lever gain calculator 24 is output to the output controller 25 (step 102), normal operating tool operation is allowed, and this process sequence ends. On the other hand, if it is less than the specific stability Ss, the machine is controlled such that the operation of both the back-hoe tool 10*a* and the loading tool 10*b* is halted immediately, and an alarm instruction is issued to the alarm section 29*a* (step 103). Thereupon, it is determined whether or not automatic avoidance mode has been set (step 104).

If the automatic avoidance mode is set, then firstly it is determined whether or not there is an operating tool that is currently at rest. For example, if the back-hoe tool 10*a* is currently in operation, but the loading tool 10*b* is not in operation, then it will be determined that there is an operating tool at rest. If there is no operating tool at rest, namely, if it is determined that all operating tools are bearing a load, then the sequence transfers to step 108, similarly to cases where the automatic avoidance mode is not set, whereas if there is an operating tool at rest, processing for cancelling the rest state of this operating tool is implemented (step 106), whereupon the operating tool at rest is relocated to a position whereby it increases the stability S (step 107), and the processing sequence then ends. Many different types of control can be conceived for the automatic relocation of the operating tool at rest as implemented in step 107, but a relocation which increases the relative angle of rotation θ is the most effective. For example, if the back-hoe tool 10*a* is in operation, and the loading tool 10*b* is at rest and is positioned in the same direction as the back-hoe tool 10*a*, the loading tool 10*b* at rest should be rotated automatically so that it lies in the opposite direction to the back-hoe tool 10*a*. Naturally, automatic avoidance is not limited to using rotation alone, and any relocation method which reduces the moment due to an operating tool at rest may be used.

On the other hand, if the automatic avoidance mode is not set, in other words, in the case of manual avoidance by the operator, it is determined whether or not the operational direction of the operating tool according to the lever control by the operator will act to reduce the stability S further (step 108). If the action will not reduce the stability S, then processing is implemented which releases the halt on this operating tool corresponding to this lever control (step 110), whereupon the action of the operating tool according to this lever control is permitted, a command for this lever control is output to the output controller 25 (step 111), and the processing sequence then ends. On the other hand, if the action is one which will reduce the stability S in step 108, namely, if the action will increase the danger of toppling, then the action of the operating tool according to this lever control is prohibited and the lever gain corresponding to this lever control is not output to the output controller 25 (step 109), whereupon the processing sequence ends. The processing sequence described above is repeated periodically.

In this way, the anti-toppling controller 22 determines the danger of toppling on the basis of the input stability S and controls the construction machine 10 such that it is completely prevented from toppling over. Here, the anti-toppling controller 22 determines the danger of toppling by judging whether the stability S is less than a single specific stability value Ss, but in addition to this, it is also possible to provide a plurality of specific stability values in a graduated system. By providing a plurality of specific stability values in this way, it is possible, for example, to provide a warning which indicates the degree of danger of toppling to the operator by changing the alarm tone produced by the alarm section 29*a* in a step fashion, and on the basis of these results, the operator can reliably prevent toppling of the construction machine, thereby eliminating interruptions in work and allowing work to be conducted efficiently.

The automatic avoidance mode set by the anti-toppling controller 22 described above, or the specific stability value Ss, and the like, may be preset by the setting section 22*a*, and the settings for the automatic avoidance mode, and the like, may also be modified during operation, according to circumstances.

The display 29*b* displays the settings in the setting section 22*a*, and also displays quantitative values for the current stability, sequentially, during operation. In this way, the colour of the display may be changed to red, for example, when the stability S falls below the specific stability Ss.

Moreover, the anti-toppling controller 22 identifies the most appropriate anti-toppling measures and displays the results on the display 29*b*, or it outputs a sound from a sound output section, or the like, which is omitted from the drawings.

Figure 6:
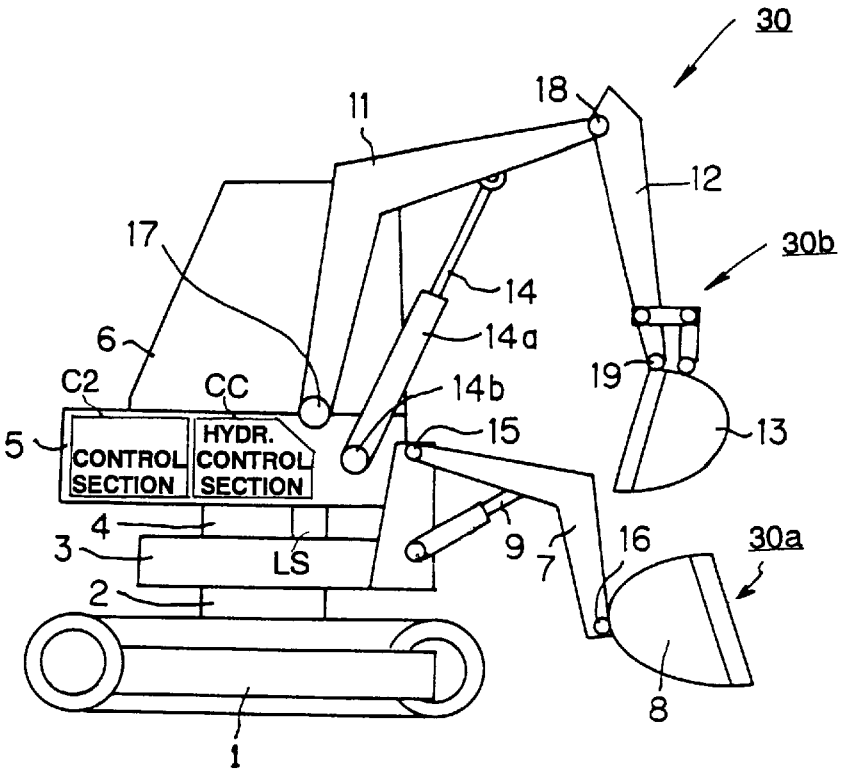
FIG. 6 is a side view showing the configuration of a construction machine which is a second embodiment for implementing the present invention.

Next, a second embodiment will be described. FIG. 6 is a side view showing the configuration of a construction machine 30 which is the second embodiment for implementing the present invention. This construction machine 30 is of practically the same configuration of the construction machine 10 in the first embodiment, and the same labels have been applied to the same component parts. However, construction machine 30 is not provided with angle detectors 15, 16, 19 for detecting the angles of rotation of the loader arm 7, loader bucket 8, and bucket 13. Furthermore, the lift cylinder 9 is not provided with pressure detectors 9*a*, 9*b* for detecting the pressure of the loader arm 7, but rather the pressure of the loader arm 7 is derived by detecting the hydraulic pressure relating to the lift cylinder 9 from the hydraulic system in the hydraulic control section CC provided on base 5. Furthermore, the relative angle of rotation between base 3 and base 5 is detected by means of a limit switch LS. This limit switch is, of course, not used in the first embodiment.

Figure 7:
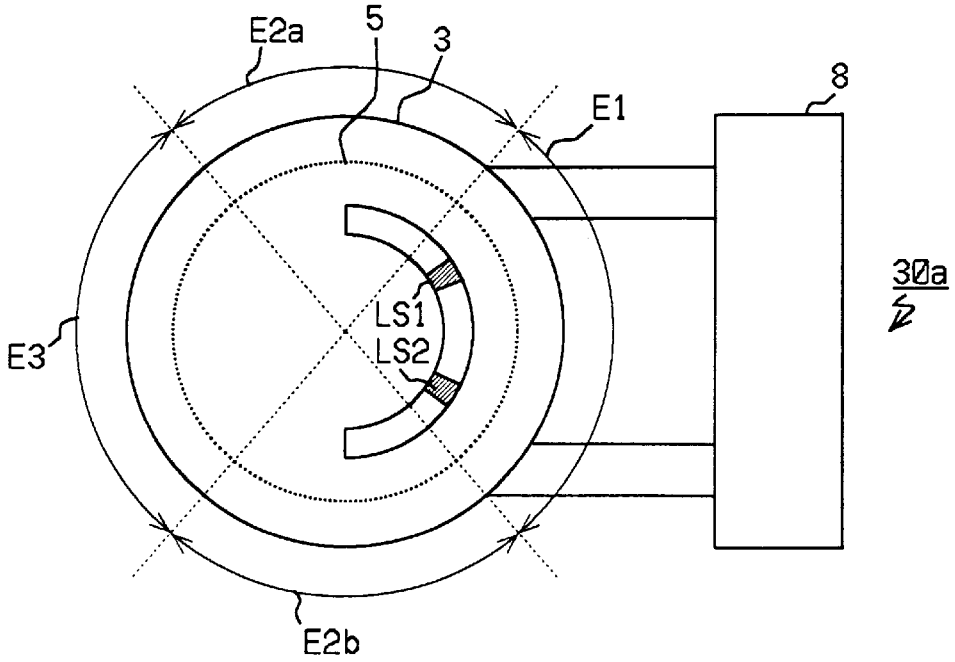
FIG. 7 is a diagram showing the approximate configuration of a limit switch LS.

Here, the specific configuration of a limit switch LS is described with reference to FIG. 7. A band-shaped metal contact surface 41 in the form of a semicircular arc (arc of 180°) having a prescribed radius is attached to the upper side of face 3, whereon a loading tool 30*a* is installed, on the loader bucket 8 side thereof, and two metal contact points LS1, LS2, which rub against the metal contact surface 41 and correspond to the prescribed radius of the metal strip 41 are provided on the under side of base 5. These two metal contact points LS1, LS2 are positioned respectively at an angle of 30° to the left and right of the centre of the back-hoe tool 30*b* side of the base 5, and there is an angle of 60° therebetween. Consequently, if both metal contact points are in contact with the metal contact surface 41, this indicates region E1 (120°), where the back-hoe tool is judged to be lying in the same direction as the loading tool 30*a*; if only metal contact point LS1 or LS2 is in contact with the metal contact surface 41, then this indicates regions E2*a* or E2*b* (30°), where the back-hoe tool 30*b* is judged to be lying in a direction at 90° to the loading tool 30*a*; and if neither metal contact points LS1 or LS2 are in contact with the metal contact surface 41, then this indicates region E3 (120°), where the back-hoe tool 30*b* is judged to be lying in the opposite direction to the loading tool 30*a*.

Figure 8:
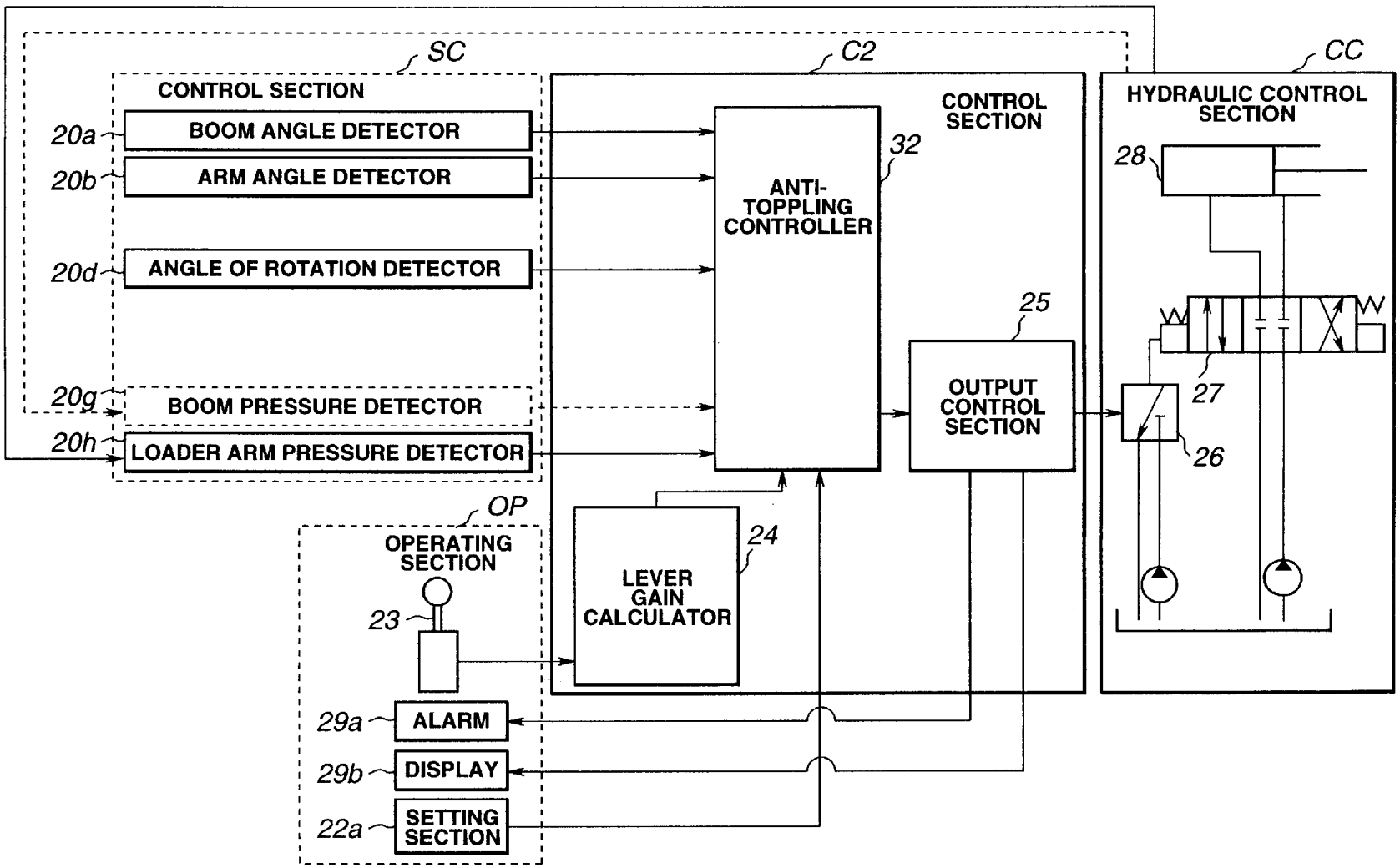
FIG. 8 is a diagram showing the configuration of an anti-toppling device for a construction machine of the second embodiment.

FIG. 8 is a diagram showing the configuration of an anti-toppling device for the construction machine 30 forming the second embodiment. This anti-toppling device is of practically the same configuration as the anti-toppling device shown in FIG. 2, and the same labels have been applied to the same component parts. However, the anti-toppling device shown in FIG. 7 is not provided with a bucket angle detector 20*c*, loader arm angle detector 20*e*, loader bucket detector, or boom pressure detector 20*g*, as in the anti-toppling device shown in FIG. 2, and moreover, no moment calculator 21 is provided and the anti-toppling controller 32 controls the machine in a different manner to the anti-toppling controller 22. Also, the control section C2 and hydraulic control section CC corresponding to control section C are both located on base 5.

In FIG. 8, the anti-toppling device for construction machine 30 comprises, in broad terms, a detecting section SC, operating section OP, control section C1, and a hydraulic control section CC, similarly to the anti-toppling device in construction machine 10.

The boom angle detector 20*a* and arm angle detector 20*b* in the control section SC reconvert angle information detected by angle detectors 17, 18 to analogue or digital electrical signals and transmit these to the control section C2. The angle of rotation detector 20*d* transmits information indicating the angle detected by the limit switch LS, in other words, whether the operating tools lie in the same direction, at 90°, or in opposite directions, to the control section C2. The loader arm pressure detector 20*h* produces an electrical signal corresponding to the loader arm pressure detected by the loader arm hydraulic control system in the hydraulic control section CC.

The control section C2 comprises an anti-toppling controller 32, a lever gain calculator 24, and an output controller 25.

The anti-toppling controller 32 judges toppling on the basis of various information input from the detecting section SC, and it implements a variety of anti-toppling control processing on the basis of these judgement results. This anti-toppling control processing is described later.

The lever gain calculator 24 amplifies and converts the input from an operating lever 23 and outputs the results of this conversion to the anti-toppling controller 32.

On the basis of the control processing results from the anti-toppling controller 32, the output controller 25 implements controls which it outputs to the hydraulic control section CC controlling the hydraulic systems of the operating tools 30*a*, 30*b*, the alarm 29*a*, which gives a notification when there is a possibility of toppling, and the display, which outputs at the least the danger of toppling or the aforementioned stability level, sequentially.

The hydraulic control section CC controls the hydraulic cylinder 28 of the left cylinder 9 or boom cylinder 14, or the like. The output control electrical signal from the output controller 25 is input to an electromagnetic proportional valve 26 which outputs a pilot pressure for controlling a main valve 27 to the main valve 27 on the basis of this output control electrical signal. The main valve 27 controls switching on the basis of the input pilot pressure, thereby controlling the driving of the hydraulic cylinder 28. Incidentally, FIG. 8 relates to control of the hydraulic cylinder 28, but when controlling the rotating mechanisms 2, 4, the hydraulic motors forming the rotational motors are subjected to this control processing.

Next, the anti-toppling control processing sequence implemented in the anti-toppling controller 32 is described with reference to the flow-chart in FIG. 9.

Figure 9:
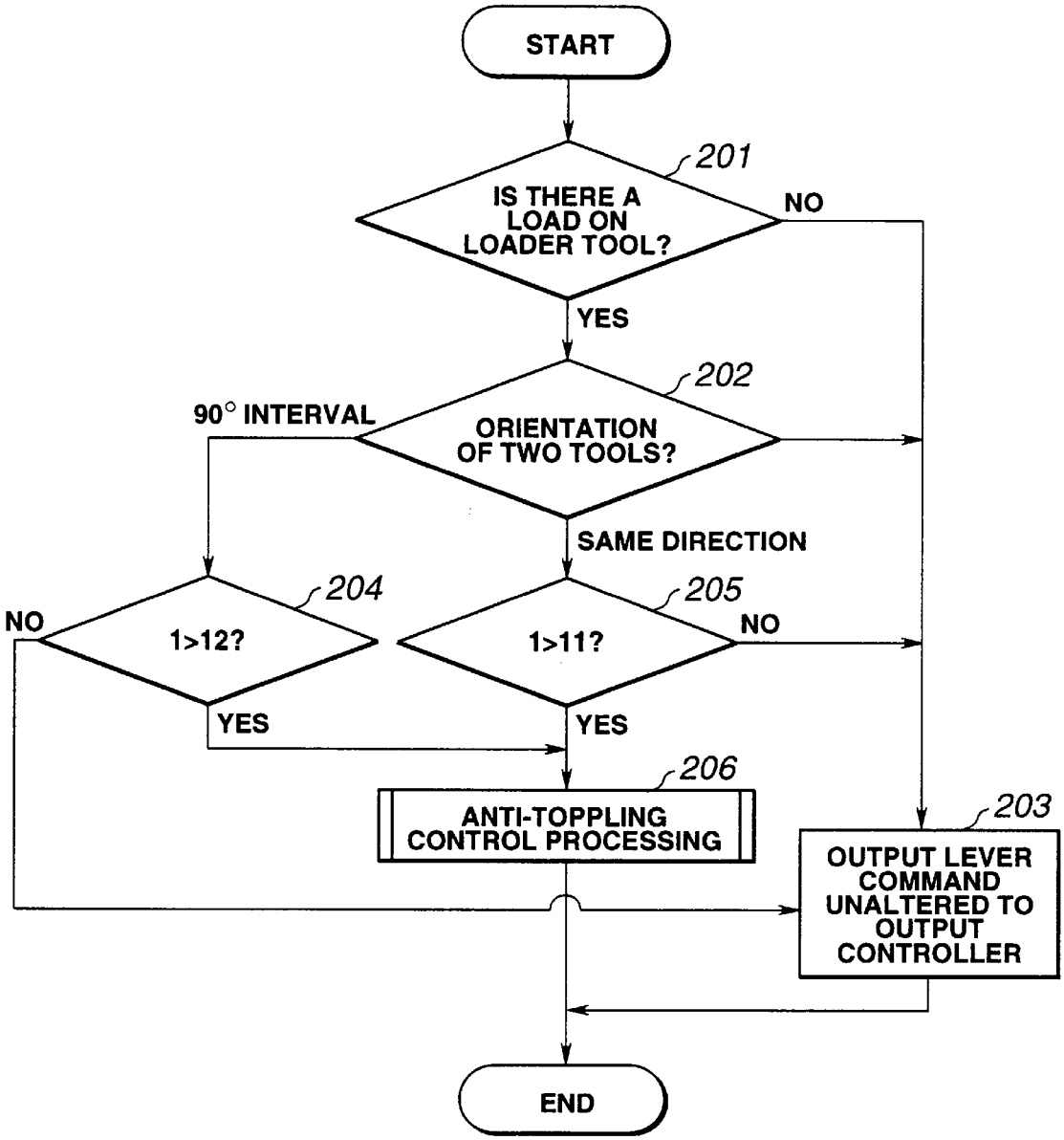
FIG. 9 is a flowchart showing a judgement and control sequence for preventing toppling as implemented in an anti-toppling controller 32.

In FIG. 9, firstly, the anti-toppling controller 32 determines whether the loading tool 30*a* is bearing a load above a specific value, in other words, it judges whether or not the pressure value input from the loader arm pressure detector 20*h* is above a specific value (step 201). This specific value is a predetermined value and is the pressure value generated when a specific load is applied to the loader bucket 8, where the loading tool 30*a* is in a state of maximum extension, and any value exceeding this pressure value is regarded as indicating that the moment due to the loading tool 30*a* itself is contributing significantly to the toppling of the whole construction machine 30. If the pressure value is not above the specific value in step 201, then the sequence proceeds to step 203, a command from the lever gain calculator 24 is output to the output controller 25, and normal operating tool operation is permitted, whereupon this processing sequence ends.

However, if it is judged at step 201 that the load borne by the loading tool 30*a* is greater than the specific value, then a value for the relative positional information relating to the loading tool 30*a* and the back-hoe tool 30*b*, as input from the angle of rotation detector 20*d* is determined (step 202), and different processing steps are taken depending on this relative positional information.

Figure 11A:
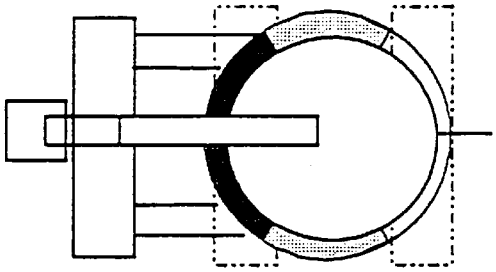
FIGS. 11(*a*) through 11(*c*) are diagrams showing one example of relative positional relationships between a plurality of operating tools according to the rotation of a plurality of operating tools.
Figure 11B:
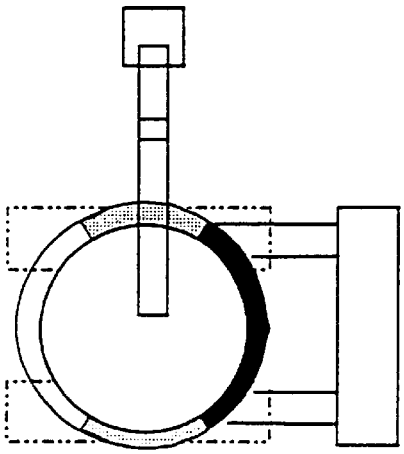
Figure 11C:
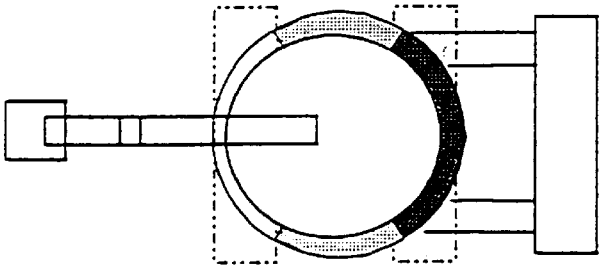
Figure 12:
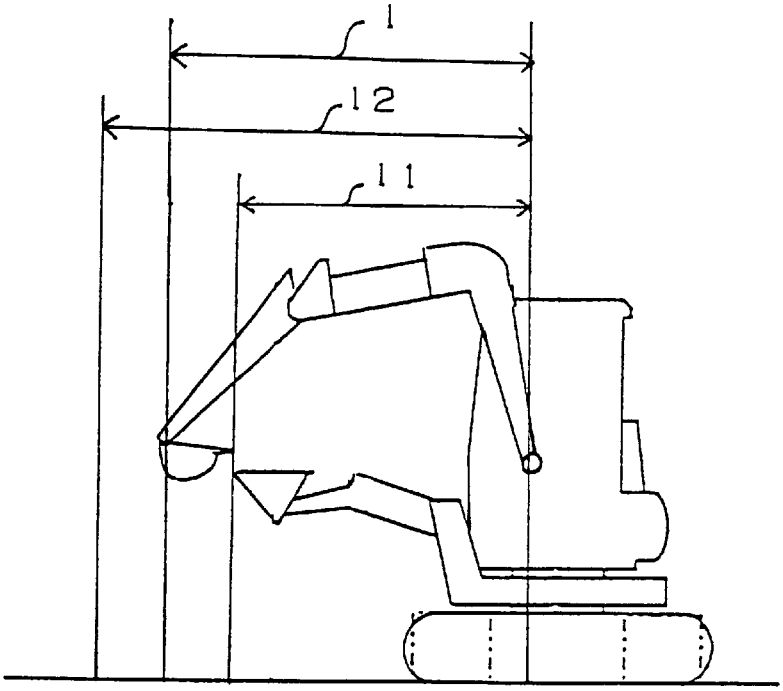
FIG. 12 is a diagram showing the relationship between the distance 1 from the installation point of a back-hoe tool 30*b* on a base 5 to the installation point of a bucket 13 on an arm 12, and reference distances 11, 12 based on relative angles of rotation.

In other words, when the relative positional information indicates that the operating tools are in opposite directions, the sequence proceeds to step 203, and a command from the lever gain calculator 24 is output to the output controller 25, normal operating tool operation is permitted, and the processing sequence ends. If the relative positional information indicates an angle of 90° between the operating tools, as illustrated in FIG. 11(*b*), then the distance 1 from the installation point of the back-hoe tool 10*b* on the base 5 to the installation point of the bucket 13 on the arm 12 is calculated from the boom angle and arm angle input by the boom angle detector 20*a* and arm angle detector 20*b*, and it is determined whether or not this distance 1 is greater than a prescribed distance 12 (step 204). Furthermore, if the relative positional information indicates that the operating tools are in the same direction, as illustrated in FIG. 11(*a*), then the distance 1 from the installation point of the back-hoe tool 10*b* on the base 5 to the installation point of the bucket 13 on the arm 12 is calculated from the boom angle and arm angle input by the boom angle detector 20*a* and arm angle detector 20*b*, and it is determined whether or not this distance 1 is greater than a prescribed distance 11 (step 205). Here, the prescribed distances 11 and 12 are predetermined values, similarly to the specific value in step 201, and they indicate values at which the moment due to the back-hoe tool 30*b* itself is regarded as contributing significantly to the toppling of the construction machine 30 as a whole, in a state where a prescribed load is applied to the bucket 13 of the back-hoe tool 30*b* and the back-hoe tool 30*b* is extended (see FIG. 12). Furthermore, two prescribed distances 11 and 12 are specified because they differ with the relative positional relationship of the loading tool 30*a* and the back-hoe tool 30*b*. In other words, when the loading tool 30*a* and the back-hoe tool 30*b* are facing in the same direction, their respective moments form a composite moment which makes the whole construction machine 30 liable to topple over, whereas if the loading tool 30*a* and back-hoe tool 30*b* are facing in opposite directions, the difference between their respective moments is applied to the whole construction machine 30, making the machine not liable to topple over, and furthermore, if the loading tool 30*a* and back-hoe tool 30*b* are facing at 90° to each other, there is an intermediate danger of toppling. Consequently, prescribed distance 12 is a greater value than prescribed distance 11, thereby allowing a greater margin in judging toppling when the operating tools are facing at 90° to each other than when they are facing in the same direction.

If it is determined at step 204 and step 205 that the distance 1 is not greater than the prescribed distance 11 or 11, then the sequence proceeds to step 203, a command from the lever gain calculator 24 is output to the output controller 25, and normal operating tool operation is permitted, whereupon the processing sequence ends.

However, if it is determined at step 204 and step 205 that the distance 1 is greater than the prescribed distance 12 or 11, then the sequence proceeds to step 206, where anti-toppling control processing is implemented, and the sequence then ends.

The anti-toppling control processing in step 206 is similar to that implemented in steps 103–111 in FIG. 5, and it is now described with reference to the flow-chart in FIG. 10.

Figure 10:
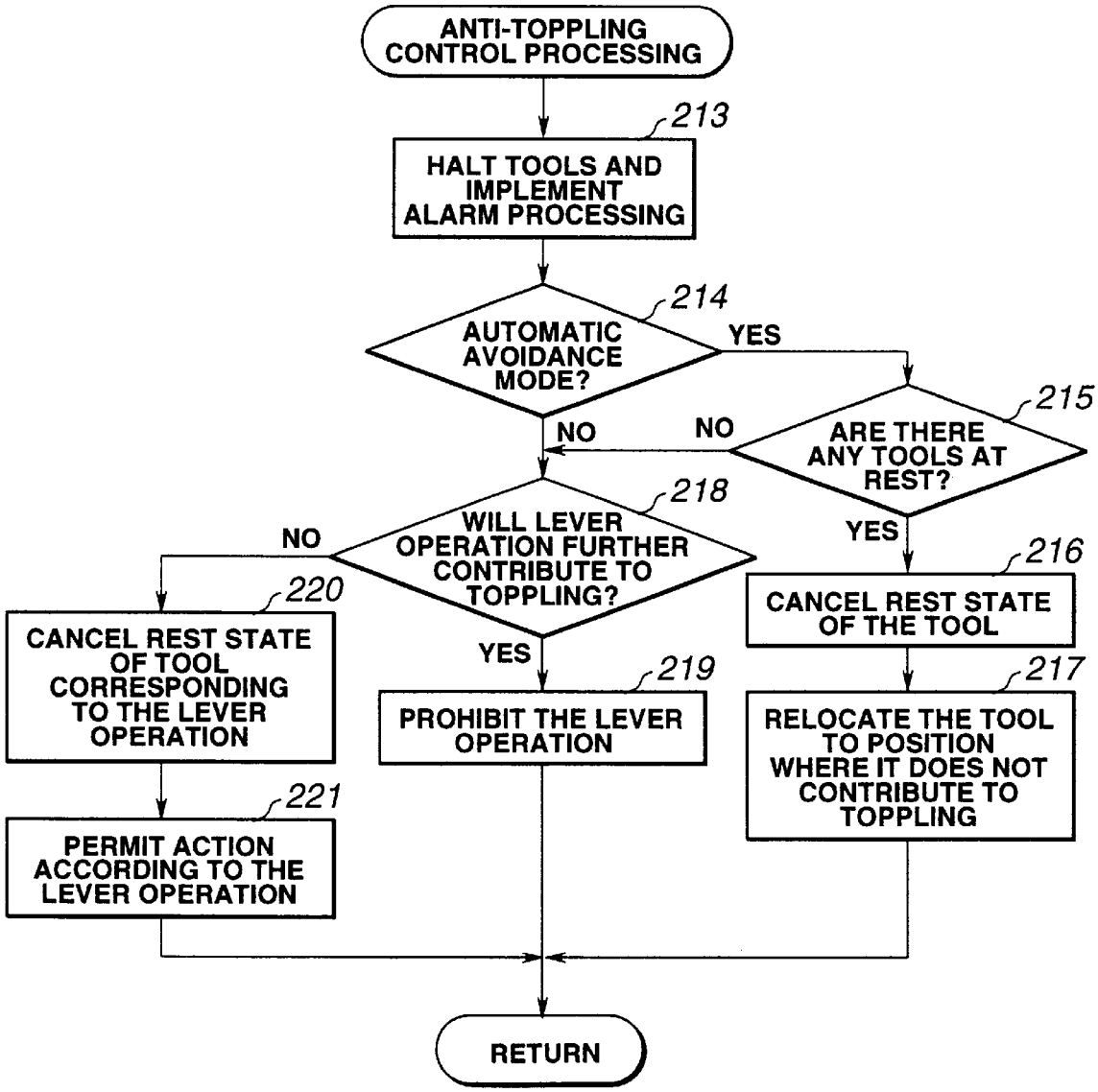
FIG. 10 is a flowchart showing a control sequence for preventing toppling in step 206.

In FIG. 10, firstly, the machine is controlled such that both the back-hoe tool 30*a* and the loading tool 30*b* are halted immediately, and an alarm instruction is issued to the alarm 29*a* (step 213). It is then determined whether or not automatic avoidance mode is set (step 214).

If automatic avoidance mode is set, firstly, it is determined whether or not there are any operating tools that are currently at rest (step 215). For example, if the back-hoe tool 30*a* is currently in operation but the loading tool 30*b* is at rest, then it will be determined that there is an operating tool at rest. If there is no operating tool at rest, in other words, if it is determined that both the operating tools are bearing loads, then the sequence proceeds to step 218, similarly to cases where automatic avoidance mode is not set, whereas if there is an operating tool at rest, processing for cancelling the rest state of this operating tool is implemented (step 216), whereupon the operating tool at rest is relocated to a position whereby it does not contribute to toppling (step 217), and the processing sequence then ends. Many different types of control can be conceived for the automatic relocation of the operating tool at rest as implemented in step 217, but a relocation which increases the relative angle of rotation θ is the most effective. For example, if the back-hoe tool 30*a* is in operation, and the loading tool 30*b* is at rest and is positioned in the same direction as the back-hoe tool 30*a*, the loading tool 30*b* at rest should be rotated automatically so that it lies in the opposite direction to the back-hoe tool 30*a*. Naturally, automatic avoidance is not limited to using rotation alone, and any relocation method which reduces the moment due to an operating tool at rest may be used.

On the other hand, if the automatic avoidance mode is not set, in other words, in the case of manual avoidance by the operator, it is determined whether or not the operational direction of the operating tool according to the lever control by the operator will act to contribute further to toppling (step 218). If the action will not contribute to toppling, then processing is implemented which releases the halt on the operating tool corresponding to this lever control (step 220), whereupon the action of the operating tool according to this lever control is permitted, a command for this lever control is output to the output controller 25 (step 221), and the processing sequence then ends. On the other hand, if the action is one which will contribute to toppling in step 108, namely, if the action will increase the danger of toppling, then the action of the operating tool according to this lever control is prohibited, and the command corresponding to this lever control is not output to the output controller 25 (step 109), whereupon the processing sequence ends. The processing sequence described above is repeated periodically.

In this way, the anti-toppling controller 32 judges and controls anti-toppling processing by means of the pressure (load) forming a single moment component of the loading tool 30*a*, the distance 1 forming a single moment component of the back-hoe tool 30*b*, and the relative angle of rotation, alone. Therefore, this second embodiment does not require a composite moment to be calculated, as and when necessary, for the whole construction machine from all the moment components for the body of the construction machine and the operating tools, as in the first embodiment, and hence, the load on the anti-toppling device for toppling judgement processing is reduced.

Moreover, in the second embodiment, the anti-toppling device is located on base 5, the moment component for the loading tool 30*a* installed on base 3 is detected by means of pressure, and the relative angle of rotation is also detected by means of the metal contact points LS1, LS2 installed on the under side of base 5. Therefore, between base 5 and base 3 only a hydraulic swivel is required to form a mechanism for connecting base 5 to the hydraulic system of base 3 even when base 5 rotates, but no electrical swivel is required, thereby simplifying the overall configuration of the construction machine 30.

Although only the distance 1 is detected of the moment components for the back-hoe tool 30*b*, it is also possible to determine further whether or not the back-hoe tool 30*b* will contribute to toppling by detecting other moment components, for example, the boom pressure in the boom cylinder 14, and it is also possible to determine precisely whether or not the back-hoe tool 30*b* will contribute to toppling by calculating the moment due to the back-hoe tool 30*b* from the distance 1 and the boom pressure.

Furthermore, in the second embodiment, the relative angle of rotation is divided into three regions, namely, the same direction, 90° interval and opposite directions, and toppling is determined on the basis of prescribed distances 11, 12 corresponding to these regions, but it is also possible to judge toppling by detecting the relative angle of rotation continuously or in a step fashion, and comparing the size of a prescribed distance corresponding to the prescribed distances 11, 12, etc. which is set in a step fashion or corrected continuously in response to the detected relative angle of rotation.

Moreover, in the second embodiment, toppling is judged by a size comparison with prescribed distances 11, 12 which differ according to the relative angle of rotation, but conversely, it is also possible to judge toppling by correcting the detected length in response to the relative angle of rotation, and comparing the size of this corrected distance 1 with a single prescribed distance 11 (corresponding to prescribed distances 11, 12 etc.).

In this case, for example, it is possible to produce a warning which indicates the degree of probability of toppling to the operator by changing the alarm sound produced by the alarm 29*a* continuously or in a step fashion, or the like. Therefore, the operator can reliably prevent toppling of the construction machine, thereby eliminating interruptions in work and allowing work to be conducted efficiently.

If the detected distance 1 or prescribed distance 11 is corrected in response to the relative angle of rotation, then this correction can be conducted by changing the actual value of the distance 1 or prescribed distance 11, or by multiplying the distance 1 or prescribed distance 11 by a factor corresponding to the relative angle of rotation.

Figure 13:
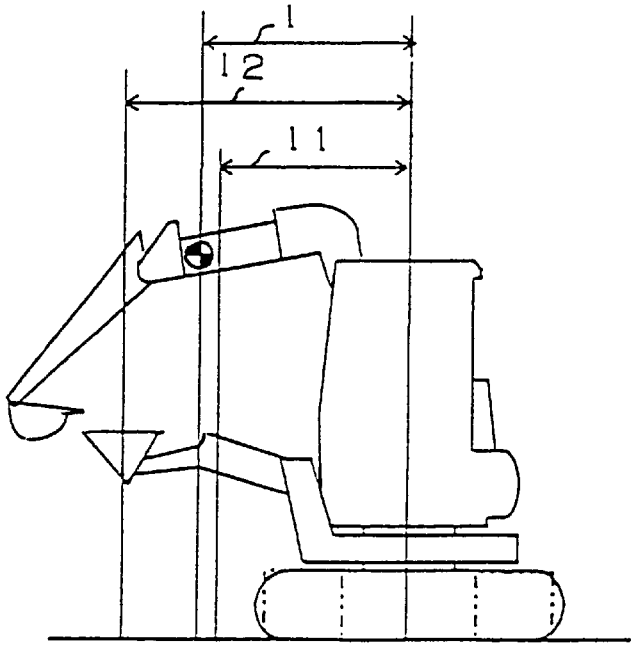
FIG. 13 is a diagram showing the relationship between the distance 1 from an axis of rotation to the centre of gravity of a back-hoe tool 30*b* itself, and reference distances 11, 12 based on relative angles of rotation.
Figure 14A:
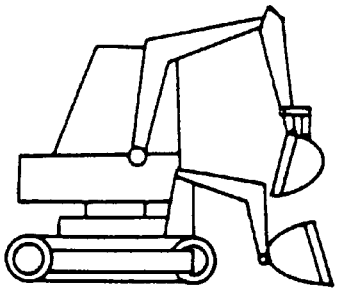
FIGS. 14(*a*) through 14(*e*) are diagrams showing the configurations of a construction machines in which operating tools are positioned in different ways.
Figure 14B:
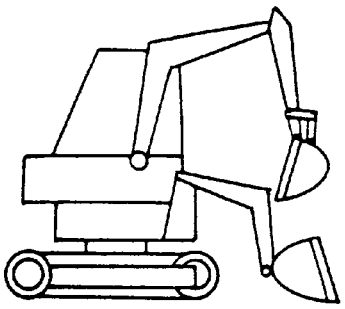
Figure 14C:
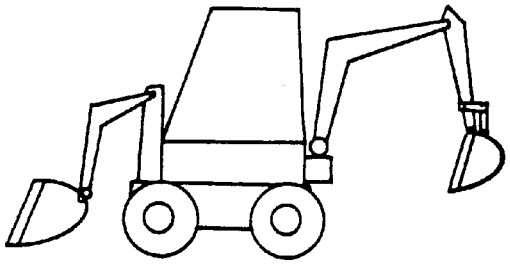
Figure 14D:
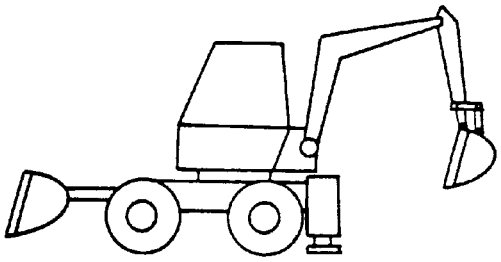
Figure 14E:
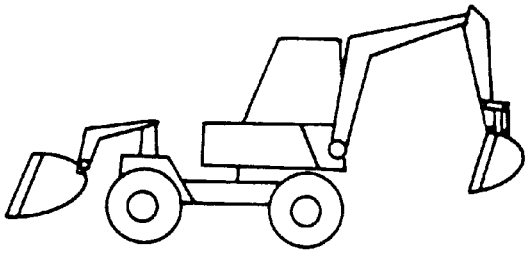

In addition, in the second embodiment described above, distance 1 was taken as the distance from the installation point of the back-hoe tool 30*b* on base 5 to the installation point of the bucket 13 on the arm 12, but besides this, it is also possible, for example, to take the distance from the axis of rotation to the centre of gravity of the back-hoe tool 30*b* itself, and to judge toppling according to whether or not this distance 1 is greater than prescribed distance 11 or 12. In this case, if the boom pressure is detected, then the centre of gravity can be calculated more accurately by taking the load on the bucket 13 into account (see FIG. 13).

Here, an example of a construction machine incorporating the aforementioned anti-toppling device is described with reference to FIGS. 14(*a*)–14(*e*).

The construction machine 10 shown in FIG. 1 and the construction machine 30 shown in FIG. 6 have crawler type mobile platforms 1, but they may also have mobile platforms 1 with tyres (see FIG. 14(*c*), (*d*), (*e*)).

In the construction machines 10 and 30, the back-hoe tools 10*a*, 30*a*, and the loading tools 10*b*, 30*b* are all independently rotatable, but it is also possible to make only the back-hoe tools 10*a*, 30*a* rotatable (see FIGS. 14(*a*), (*d*)). Of course, it is also possible, conversely, to make only the lower operating tool rotatable (see FIG. 14(*b*)).

Moreover, the configuration of the construction machines 10 and 30 involves superimposing a plurality of rotating mechanisms in a vertical direction, but it is also possible to employ a structure whereby a plurality of rotating mechanisms are separated in a horizontal direction (see FIG. 14(*e*)).

In other words, the construction machine relating to the present invention should comprise a plurality of operating tools, at least one of which is rotatable, installed on a single mobile platform, and it may combine the variety of functions and configurations described above. The anti-toppling device refers to the back-hoe tool 10*a*, 30*a*, for example, as described above, and it is capable of implementing the same control, whether the other operating tool is fixed or rotatable. Of course, if the machine comprises no rotating operating tools, then the anti-toppling control processing is designed to correspond accordingly.

What is claimed is:

1. An anti-toppling device for a construction machine which moves by means of a mobile platform and performs tasks by means of a plurality of operating tools, comprising:

first detection means for detecting the relative angle of rotation of the plurality of operating tools;

a plurality of second detection means for detecting values of moment components contributing to toppling for each of the plurality operating tools; and control means for judging toppling of the construction machine on the basis of the detection signals from the first and second detection means and controlling the construction machine such as to be prevented from toppling over on the basis of results of the judgement.

2. The anti-toppling device for a construction machine according to claim 1, wherein, when the value of the moment component in a particular operating tool as indicated by the detection signal from the second detection means corresponding to the operating tool exceeds a specific value previously determined on the basis of the moment of the particular operating tool in an operational state where the operational state of the particular operating tool contributes towards the toppling of the construction machine, the control means determines that the current operational state of the particular operating tool is contributing towards the toppling of the construction machine.

3. The anti-toppling device for a construction machine according to claim 2, wherein the second detection means corresponding to the particular operating tool detects the value of the moment component of the particular operating tool by means of pressure.

4. The anti-toppling device for a construction machine according to claim 2, wherein the second detection means corresponding to the particular operating tool is provided on the base of the operating tool where the control means is located.

5. The anti-toppling device for a construction machine according to claim 2, wherein the control means implements control such that the plurality of operating tools are halted and thereafter, operation of those operating tools of the plurality of operating tools which do not contribute to toppling is permitted, when the judging means judges that there is a possibility of toppling.

6. The anti-toppling device for a construction machine according to claim 1, wherein, when the control means judges toppling of the construction machine by comparing the value of the moment component due to a particular operating tool as indicated by the detection signal from the second detection means corresponding to the particular operating tool with a specific value previously determined on the basis of the moment of the particular operating tool in an operational state where the operational state of the particular operating tool contributes towards the toppling of the construction machine, wherein the specific value is corrected to a value corresponding to the relative angle of rotation as detected by the first detection means.

7. The anti-toppling device for a construction machine according to claim 6, wherein the control means corrects the values to values allowing a greater margin for toppling of the construction machine as the relative angle of rotation increases.

8. The anti-toppling device for a construction machine according to claim 1, wherein, when the control means judges toppling of the construction machine by comparing the value of the moment component due to a particular operating tool as indicated by the detection signal from the second detection means corresponding to the particular operating tool with a specific value previously determined on the basis of the moment of the particular operating tool in an operational state where the operational state of the particular operating tool contributes towards the toppling of the construction machine, wherein the value of the moment component is corrected to a value corresponding to the relative angle of rotation as detected by the first detection means.

9. The anti-toppling device for a construction machine according to claim 1, wherein the control means judges that there is a possibility of the construction machine toppling over when the value of the moment component indicated by the detection signal from the second detection means corresponding to one of the operating tools exceeds a specific value, and the value of the moment component indicated by the detection signal from the second detection means corresponding to the other of the operating tools exceeds a reference value corrected in response to the relative angle of rotation.

10. The anti-toppling device for a construction machine according to claim 1, further comprising moment calculating means for calculating a composite moment for the whole of the construction machine on the basis of the detection signals from the first and second detection means, wherein the control means compares the calculation result of the moment calculating means with a prescribed reference moment indicating the possibility of the construction machine toppling over, and judges that there is the possibility of the construction machine toppling over when the composite moment exceeds the prescribed reference moment.

11. The anti-toppling device for a construction machine according to claims 1, wherein at least one of the plurality of operating tools can be rotated.

12. The anti-toppling device for a construction machine according to claim 11, wherein the control means implements control such that the relative angle of rotation is increased when the judging means judges that there is a possibility of the toppling.

13. The anti-toppling device for a construction machine according to claim 1, wherein the control means implements control such that at least one of the plurality of operating tools is halted, when the judging means judges that there is a possibility of toppling.

14. The anti-toppling device for a construction machine according to claim 1, wherein the control means implements control such that it prohibits operation of the operating tools which increase the possibility of toppling, when the judging means judges that there is a possibility of toppling.

15. The anti-toppling device for a construction machine according to claim 1, wherein the control means implements control such that the operating tool is relocated to a position which reduces the possibility of toppling, when the judging means judges that there is the possibility of toppling.

16. The anti-toppling device for a construction machine according to claim 1, wherein the control means implements control such that when the possibility of toppling has increased whilst one of the operating tools is at rest due to a change in the position of another operating tool, the operating tool which is at rest is relocated to a position which reduces the possibility of toppling.

17. The anti-toppling device for a construction machine according to claim 1, further comprising alarm means for warning of the danger of the construction machine toppling over, wherein the control means implements control such that a alarm is issued by the alarm means at least, when it is judged that there is a possibility of toppling.

18. The anti-toppling device for a construction machine according to claim 1, wherein the control means calculates the moment due to an operating tool which is contributing significantly to the toppling of the construction machine on the basis of the value of a plurality of moment components indicated by the detection signals from the second detection means corresponding to that operating tool, and if the value of these moments exceeds a predetermined value, then it judges that the current operational state of this operating tool will contribute to the toppling of the construction machine.

* * * * *